US006267715B1

(12) United States Patent
Sass et al.

(10) Patent No.: US 6,267,715 B1
(45) Date of Patent: Jul. 31, 2001

(54) FOLDING MACHINE AND PROCESS FOR AUTOMATIC FOLDING OF A FOLDING BOX

(75) Inventors: Bodo Sass, Schenkenberg; Klaus Krohnert; Udo Schmidt, both of Brand-Erbisdorf; Bodo Tonnigs, Lichtenberg, all of (DE)

(73) Assignee: Ligmatech Maschinenbau GmbH, Lichtenburg (DE)

( * ) Notice: Subject to any disclaimer, the term of this patent is extended or adjusted under 35 U.S.C. 154(b) by 0 days.

(21) Appl. No.: 09/254,470

(22) PCT Filed: Sep. 5, 1997

(86) PCT No.: PCT/EP97/04833

§ 371 Date: May 6, 1999

§ 102(e) Date: May 6, 1999

(87) PCT Pub. No.: WO98/09803

PCT Pub. Date: Mar. 12, 1998

(30) Foreign Application Priority Data

Sep. 6, 1996 (DE) ..... 196 36 262

(51) Int. Cl.[7] ..... B31B 1/68

(52) U.S. Cl. ..... 493/119; 493/131; 493/150

(58) Field of Search ..... 493/128, 131, 493/150, 151, 478, 119

(56) References Cited

U.S. PATENT DOCUMENTS

| | | | | |
|---|---|---|---|---|
| 2,887,022 | | 5/1959 | Lubersky et al. . | |
| 3,013,477 | | 12/1961 | Meyer . | |
| 3,513,757 | * | 5/1970 | Frank . | |
| 4,578,054 | * | 3/1986 | Herrin | 493/131 |
| 4,585,432 | * | 4/1986 | Marysse | 493/119 |
| 4,704,100 | * | 11/1987 | Kaufman . | |
| 5,154,041 | * | 10/1992 | Schneider | 493/128 |
| 5,782,732 | * | 7/1998 | Herrin | 493/131 |
| 5,980,440 | * | 11/1999 | Mitman et al. | 493/128 |

FOREIGN PATENT DOCUMENTS

| | | |
|---|---|---|
| 1 274 430 | 8/1968 | (DE) . |
| 42 21 738 A1 | 1/1993 | (DE) . |
| 43 23 802 A1 | 1/1994 | (DE) . |
| 2 554 417 | 5/1985 | (FR) . |
| 2 628 357 | 9/1989 | (FR) . |
| 2 646 398 | 11/1990 | (FR) . |

OTHER PUBLICATIONS

Systeme zum Verpacken und Vermeidan brochure, Germany, 3 pages, publsihed prior to Sep. 6, 1996.

Mezger Heftsysteme GmbH & Co, Nurnberg, Germany, 1 page brochure, "Informations–Angebot", published prior to Sep. 6, 1996.

MG Heftsystem brochure Vollautomatische Stulpboden–Stulpdeckel–Hefsmaschine SHA, Germany, 1 page, publsihed prior to Sep. 6, 1996.

* cited by examiner

*Primary Examiner*—Eugene Kim
(74) *Attorney, Agent, or Firm*—Sughrue, Mion, Zinn, Macpeak & Seas, PLLC

(57) ABSTRACT

The present invention relates to a folding machine and a method of automatically folding a folding box made of a pre-grooved carton blank. The folding machine according to the invention is provided with at least one alignment means (5) for aligning said carton blank into a predeternined position on a receiving plane, a pre-folding flap (8) assigned to one tab (113) of said carton blank at a time for lifting said tabs (113) out of the receiving plane, said pre-folding flaps (8) being movable on the receiving plane, at least one fixing means (6) for securing said carton blank, at least one erecting flap (9, 10) assigned to one side wall (112) of said carton blank at a time, said erecting flap being movable on the receiving plane, and at least one connecting means assigned to one tab (113) at a time for connecting said tab (113) to the associated side walls.

26 Claims, 4 Drawing Sheets

FOLDING MACHINE AND PROCESS FOR AUTOMATIC FOLDING OF A FOLDING BOX

TECHNICAL FIELD

The present invention relates to a folding machine and a method of automatically folding a folding box out of a pre-grooved carton blank.

To package an extremely wide variety of articles, use is made of folding boxes folded out of carton blanks which are supplied as flat sheets and which can be easily transported by being stacked on top of one another. The carton blanks usually consist of solid board or multilayer corrugated cardboard. Items of furniture such an carcass parts or front panel sections etc. particularly prepared for later assembly are dispatched in such folding boxes.

The objects designated here as folding boxes may be designed in different ways. One conceivable type of folding box is that folded out of a pre-grooved carton blank which comprises a base, side walls and flaps adjoining the side walls. Such a structure is then known as a slip lid or slip base. But pre-grooved carton blanks which form a closed folding box are also foldable. For this purpose, in addition to the aforementioned elements, there are corresponding lids present on the carton blank. The aforementioned folding boxes are glued or stuck together, stapled or, if the carton blank is appropriately designed, just folded.

PRIOR ART

On account of items of furniture which are produced in high quantities e.g. in the furniture industry and which are to be prepared ready for dispatch, it is desirable to package these items in an automated manner as far as possible in order to save costs. It has so much been impossible, however, to devise an automatic packaging system for the objects of the aforementioned type in the desired manner with full automation since the folding boxes necessary for this purpose had to be manually pre-folded.

The combination of automatic folding and gluing is so far unknown, particularly in the case of folding boxes with glued flaps. The production of pre-folded and glued folding boxes has so far required time-consuming and expensive manual labor.

With regard to producing a stapled slip base or slip lid, a folding machine is known in which an inserted carton blank is pressed down in the area of its base section in a kind of bottom die or hollow die. Correspondingly shaped solid side walls of the hollow mold then serve to place the side walls of the carton blank upright during the process of pressing down. Such a folding machine is only known for the production of stapled slip bases. Furthermore, conversion to varyingly dimensioned carton blanks is only possible to a limited extent since a corresponding change in the size of hollow mold would involve complex structural elements in the case of folding machines that operate on the basis of the explained principle.

SUMMARY OF THE INVENTION

The technical problem upon which the invention is based is to design a folding machine and a procedure by means of which different sizes of carton blank can be mechanically folded in a simple manner.

This technical problem is solved by a folding machine for folding up a folding box made from a pre-grooved carton blank having a base with a plurality of sides and side wall, one side wall at a time being formed on one base side and being defined by one folding groove at a time, the carton blank having a plurality of tabs serving to connect two adjacent side walls when a carton blank is folded, wherein the folding machine comprises: a receiving plane on which the carton blank is placed, at least one alignment means for aligning the carton blank into a predetermined position on the receiving plane, a plurality of pre-folding flaps assigned to one table of the carton blank at a time, for lifting the tabs out of the receiving plane, the pre-folding flaps being movable on the receiving plane, at least one fixing means for securing the carton blank in the predetermined position on the receiving plane, a plurality of erecting flaps movable on the receiving plane, at least one of the erecting flaps being provided for each side wall of the carton blank to erect the side wall out of the receiving plane, and a plurality of connecting means for connecting the tabs to the associated side walls, at least one connecting means being assigned to one tab of the carton blank.

The technical problem is also solved by process of automatically folding a folding box made from a pre-grooved carton blank having a base with a plurality of sides and side walls, one side wall at a time being formed on one base side and being defined by one folding groove at a time, the carton blank having a plurality of tabs serving to connect two adjacent side walls when a carton blank is folded, wherein the process comprises the steps of: placing the carton blank onto a receiving plane, subsequently moving the carton blank into a predetermined position, holding the thus aligned carton blank at its base from the lower side, folding over the tabs of the carton blank to such an extent that without aids they continue to project out of the plane formed by the carton blank, mechanically erecting the side walls of the carton to the associated tabs.

The invention is based on the idea that instead of the "bottom die solution" explained at the start, the folding of the carton blanks is performed by a plurality of mechanically operated flaps which are movable on a common plane or surface—called the receiving plane here. This makes very flexible handling possible with regard to different sizes of the carton blanks to be folded. For the first time, it is necessary just to slide the individual elements in accordance with the dimensions of the carton blank to be folded. The adjustment to the different sizes of carton blank can be performed very easily and quickly as a result of the free movability of the flaps etc.

This concept according to the invention also makes it possible to prepare glued, stapled or just folded folding boxes on the receiving plane of movable flaps. For this purpose, it is necessary only to exchange the connecting device.

The inventive structure of the folding machine comprising at least one alignment device ensures that the carton blank is aligned into a predetermined position. It is then ensured in this position that the pre-folding flap assigned to one carton blank tab at a time can perfectly bend over the respective tab such that after pivoting back the pre-folding flap, this tab also projects out of the previous carton blank plane, causing the tabs to end up inside the folding box when the side walls are subsequently erected (i.e. put upright). The respective connecting devices can then easily connect the tabs to the side walls. The fixing device according to the invention does of course ensure that the carton blank is secured at all times.

In this way, the connecting device in a folding machine for making a glued folding box, i.e. a folding box in which the respective tabs are glued to the associated side walls, comprises a gluing device assigned to one tab at a time and movable on the receiving plane. The connecting device also comprises a pressing flap located in the area of a tab and movable on the receiving plane; this pressing flap is for pressing the glued tab and the associated side wall. If the size of the carton blanks varies, the tabs end up at different positions in the flat state on the receiving plane. Because the gluing devices are freely movable on the receiving plane, an associated adaptation is easily possible. By means of the associated pressing flap, it is easy to bring about the fact that a glued and erected tab and the associated erected side wall are securely connected together.

To form a stapled folding box, the connecting device of the folding machine according to the invention comprises one stapling device at a time, this stapling device being located in the area of a tab and movable on the receiving plane. In turn, the free movability on the receiving plane allows the assignment to a tab to be defined easily and quickly when there are different sizes of carton blank.

If the carton blank is correspondingly designed, it is also possible to prepare a folding box which is just folded. For this purpose, the carton blank has to comprise additional inner side walls. As regards such a carton blank, the folding machine according to the invention for making a folding box that is only folded comprises one additional folding-over flap at a time, this folding-over flap being rotatably disposed on the erecting flaps assigned to the additional inner side walls. Putting the side wall and inner side wall upright causes the inner side wall to be able to bend off through 180° so that the tabs are fitted between the inner side walls and side walls, which results in a rigid folding box that is just folded.

Adjustability to different sizes of carton blank is advantageously facilitated by providing on the receiving plane movable support units on which on the one hand the pre-folding flaps provided for lifting the tabs and on the other at least one of the erecting flaps are erected at each side wall. Based on the grouping on support units, not every element of the folding machine according to the invention has to be specially moved and adjusted on the receiving plane, but just the support units each assigned in corners of the carton blank.

A very advantageous embodiment comprises two movable limit stops, in the direction in which the alignment device can be positioned each time. This causes the carton blank to assume easily a defined position on the receiving plane. Different heights of the side walls of the carton blank or subsequent folding box can also be taken into consideration.

By movably aligning the limit stops in two directions perpendicular to one another, the number of necessary limit stops for a rectangular carton blank is reduced.

By movably arranging the limit stops on the support units, the basic adjustment to the carton blank size is easily possible by simply moving just the support unit.

A very simple structural design of the alignment device comprises adjusting cylinders with which the alignment device can be moved in the direction of the limit stops. The alignment device advantageously comprises suction means with which the lower side of the carton blank is secured. This structural design makes it possible to align rapidly and simply the carton blank inserted on the receiving plane. An alignment device of the aforementioned type is without complex control programs and to observe short clock times is characterized in that it can be moved in the direction of the limit stops through a complete stroke of an associated adjusting cylinder, whereby the suction force of the suction means is calculated such as to be sufficient to secure the carton blank, but such that the suction means slide relative to the carton blank when one of the limit stops is struck. Using this structure, there is no need for any complex sensor devices which detect when the carton blank has moved close to one of the limit stops. Just the movement across a complete stroke of the associated adjusting cylinders is sufficient. This structure is therefore very simple and inexpensive to design.

By providing each support unit in the area of the corners of the carton blank base with the fixing device, the carton blank is fixed at those points critical to subsequent folding. This is because precisely those corners of the carton blank where the tabs that are still to be erected end up are exposed to larger loads during subsequent mechanical folding.

Designing the fixing device with at least one suction means with which the lower side of the base can be secured enables free access to the upper side of the carton blank in a simple manner, e.g. for the pressing flaps or stapling means to be actuated later.

By using adjusting cylinders to enable the erecting flaps to rotate through 90° out of the receiving plane of the carton blank, free access to the upper side of the carton blank is again made possible. Such a structural design is also inexpensive and reliable.

Designing the pre-folding flap as a hook-shaped element which is rotatable around a rotary axis enables the tabs to be folded over by far more than 90°, but the pre-folding flap itself just by about half the angular amount. This makes a very space-saving design possible.

A very simple design and reliable actuation of the pre-folding flap is given by the fact that the pre-folding flap can be rotated by means of an adjusting cylinder. The effect that the pre-folding flap has to be rotated by a smaller angular amount than the tab's folding process would require is enhanced by an arcuate surface on the hook-shaped element; this arcuate surface points toward the tab.

This aforementioned design of the hook-shaped element is additionally assisted by spacing the projection point for the adjusting cylinder at a distance from the rotary axis of the hook-shaped element.

An optimum design is obtained when in its unfolded state, the tab is located in the outer region of the hook-shaped element and the rotary axis is located in the region of the pre-grooved depression in the carton blank.

In the case of the rectangular carton blanks predominantly to be folded, a simple shape is obtained by disposing four supports on a rectangular base trestle; of these supports, two at a time are spaced apart from one another in parallel and each pair of supports is disposed perpendicular to one another. This structure enables a very easy and rapid adjustment to the particular size of carton blank.

To do so, it is advantageous for the support units to be each movably disposed in the area of intersecting supports and along these supports. This structure causes the support units to be entrained when the supports are shifted, therefore allowing the correct adjustment to the respective size of carton blank to be achieved just by setting the supports.

By disposing additional erecting flaps on the supports, very large side-wall lengths can also be folded without problem.

When designing the folding machine for folding and gluing folding boxes, a structure which is simple in technical terms is obtained by rotatably disposing the pressing flaps on the erecting flaps by means of an intermediate member. This causes the receiving plane for the carton blanks not to be freely accessible by any elements, thus enabling a carton blank to be easily inserted without any obstructing elements. As a result of the three-membered design of the erecting flap and pressing flaps, the preceding arranging movement of the erecting flaps for the side walls is also used for the fact that just two more 90° movements are needed to press against the tabs and side walls. Such a design can also be used to fold folding boxes which have only been folded. The pressing flap is then used as a folding flap for the inner side wall.

A reliable and inexpensive design of the gluing means is obtained by including nozzles that are directed at the lower side of the tabs and with which a suitable adhesive can be applied to the lower side of the tabs.

A wide variety of adhesives can be used for the gluing means, it must only be ensured that the adhesive is not dried from the time of applying the adhesive to the tabs until pressing by means of the pressing flaps. A hot-melt adhesive in which curing begins only during pressing is particularly suitable. In other words, the tab and associated side wall are securely connected together by applying pressure for short periods.

BRIEF DESCRIPTION OF THE DRAWINGS

So as to explain the invention further and understand it better, various exemplary embodiments will now be described and explained in more detail with reference to the attached drawings.

DETAILED DESCRIPTION OF THE PREFERRED EMBODIMENT

1st Exemplary Embodiment

Figure 1:
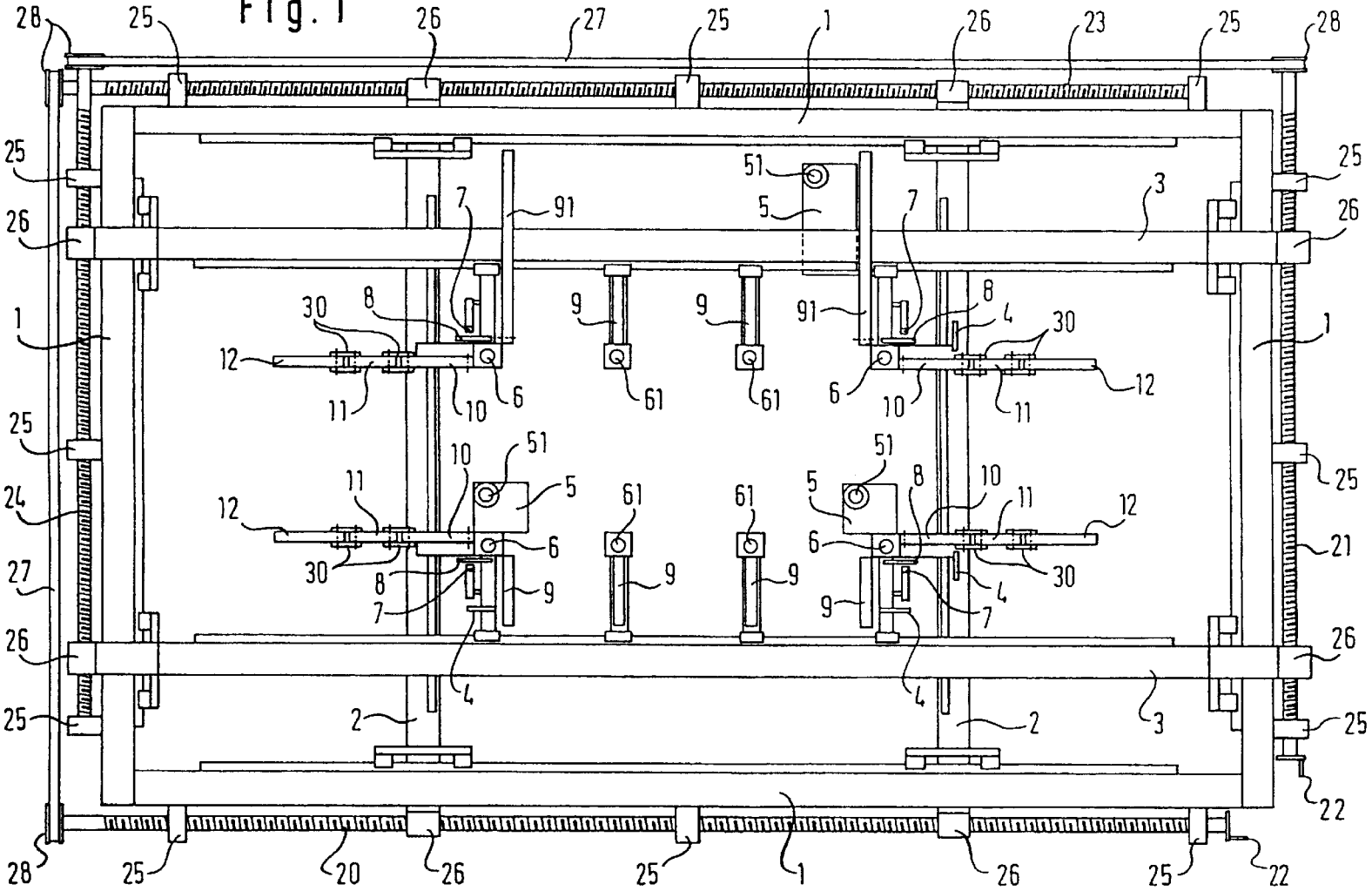
FIG. 1 shows a schematic horizontal projection of a first exemplary embodiment of a folding machine with gluing means according to the invention.

FIG. 1 shows a horizontal projection of a folding machine according to the invention for four-sided carton blanks. The depicted folding machine comprises a rectangular base trestle 1. Spindles 20, 23; 21 24 extend at respectively opposite outsides of the base trestle 1. The spindles 20, 21, 23 and 24 are each secured to the outsides of the base trestle 1 by means of a plurality of spaced apart spindle bearings 2S.

Rolls 28 are secured against rotation to the end faces of respectively opposite spindles 20, 23; 21, 24. One endless belt 27 at a time is looped around rolls 28 which face one another. Rotary handles 22 are attached to facing end faces of two spindles. The opposite spindles 20, 23; 21, 24 work in opposite directions to one another.

Two longitudinal supports 3 in parallel with one another extend between the opposed spindles 21, 24. The longitudinal supports are disposed, via support spindle nuts 26, on the opposite spindles 21, 24 which work in opposite directions to one another.

Two parallel transverse supports 2 are disposed beneath the longitudinal supports 3, again by means of support spindle nuts 26 on the other two opposite spindles 20, 23 which work in opposite directions to one another.

In the horizontal projection, a rectangular frame is clamped by the longitudinal supports 3 and transverse supports 2. One support unit at a time is positioned in each corner of this rectangular frame. Each support unit is movably fastened both to a longitudinal support 3 and to a transverse support 2; e.g. in that grooves into which corresponding formations of the support units are fitted extend in the longitudinal direction of the transverse supports 2 and longitudinal supports 3.

In this exemplary embodiment, each support unit is provided with gluing means 7. In this particular case, the gluing means 7 comprises an essentially upwardly directed nozzle and is connected to a storage tank for the glue, adhesive etc. by means of a hose connection. The nozzle is directed at the lower side of a tab of a carton blank to be fitted on.

In the immediate vicinity of the gluing means 7, a pre-folding flap 8 is disposed on each support unit. The design of the folding flap 8 will be described further with reference to FIG. 2.

Figure 4:
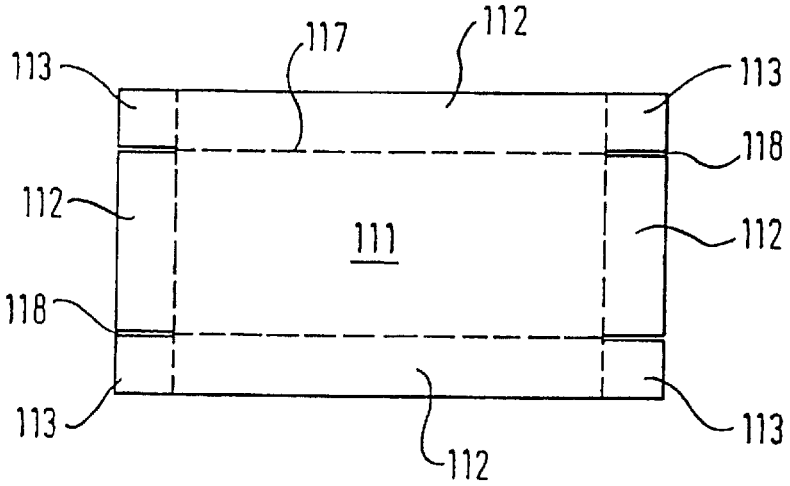
FIG. 4 shows a horizontal projection of a carton blank for a slip lid or slip base.

Each carton blank to be inserted comprises a base 111 (see, e.g., FIG. 4). A fixing means 6 located in the corner region of the carton blank's base is disposed on the support unit in each corner region. Each fixing means 6 is composed of a suction means that can travel vertically.

At the longitudinal sides of a carton blank to be inserted are disposed erecting flaps 9 on the support units in the end region of the side walls of a carton blank. The erecting flaps 9 are aligned horizontally in the starting position and are each rotated through 90° via adjusting cylinders. In its starting position, a carton blank which is to be inserted is located such that the side wall of a carton blank is situated in the region of the flap.

If the carton blank is also fitted with a lid, the erecting flaps 91 are provided with a longer support member. Additional holding means are also provided for the lid region.

In the longitudinal direction of the longitudinal supports 3, additional erecting flaps 9 are movably secured between the erecting flaps 9 or 91 on the support units. These erecting flaps 9 have the same design as those on the support units. But they are also fitted with further, vertically positionable suction means 61 for the base ill of the carton blank.

Three-membered elements with erecting flaps 10, intermediate members 11 and pressing flaps 12 are each provided on the support, units at those sides facing the transverse sides of the carton blank. These three-membered elements will be described below in even more detail with reference to FIG. 3.

Finally, alignment means 5 are secured to two support units in the region of the base of the carton blank to be fitted on. An additional alignment means 5 is secured, via a further support unit, to an opposite longitudinal support 3 and the associated transverse support 2. Each alignment means 5 comprises vertically positionable suction means 51 with suckers rotatable around their vertical axis. The alignment means can not only travel toward the longitudinal supports by a predetermined stroke path, but they can also travel along the transverse supports by a predetermined stroke path.

Limit stops 4 are adjustably secured to the two support units disposed on a transverse support 2. These limit stops form an abutment surface perpendicular to the transverse support's direction of extension. Limit stops 4 are in turn respectively secured, in a movable manner along the transverse supports 2, to a support unit of the aforementioned support units and an opposite support unit. These limit stops comprise an abutment surface pointing perpendicular to the abutment surface of the previous limit stops 4.

Figure 2:
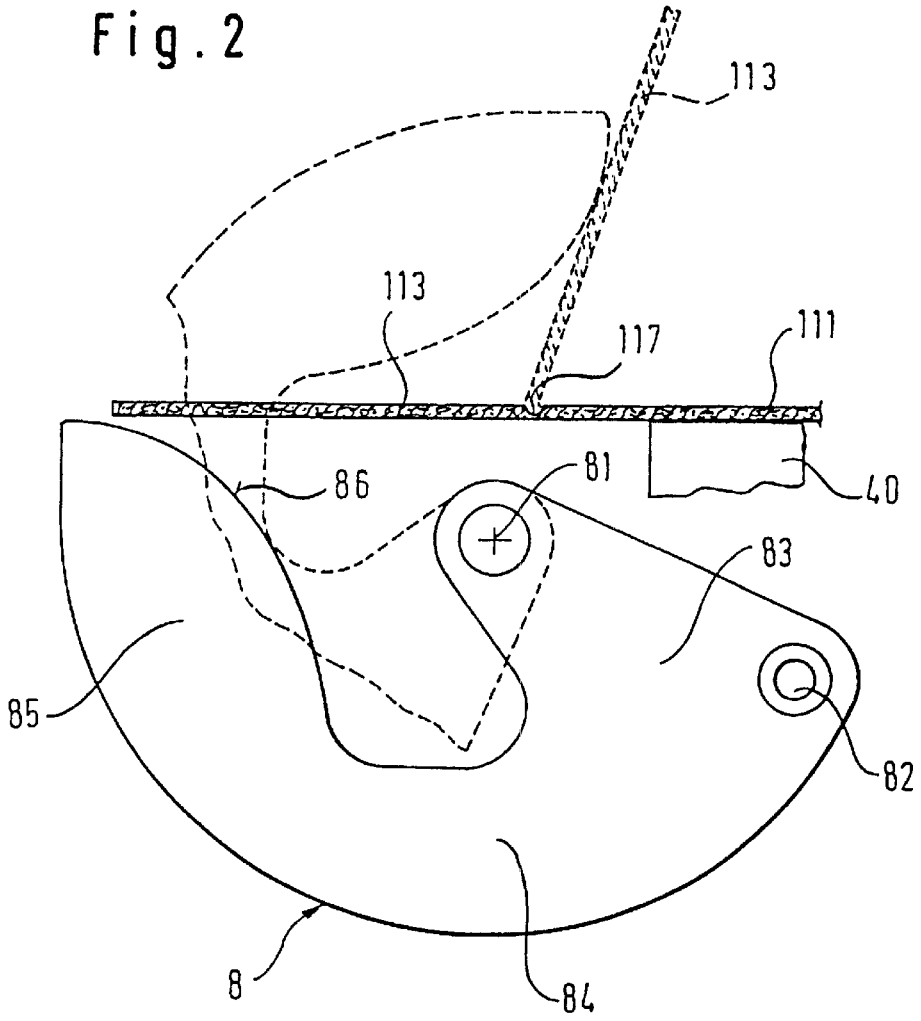
FIG. 2 shows a schematic side view of a pre-folding flap in the starting and final positions.

An example of the shape of a pre-folding flap 8 is evident from FIG. 2. The pre-folding flap 8 has a front member 85 which has an arcuate bulge when viewed from the side. This is adjoined by a central member 84 located horizontally in the starting position of the pre-folding flap 8. A base member 83 adjoins the central member 84. The base member 83 has a bore for a rotary axis 81 around which the pre-folding flap 8 is rotatable. A bore 82 for receiving a coupling joint for an adjusting cylinder is spaced apart from the rotary axis 81.

The pre-folding flap 8 is arranged in relation to a support 40 of a support unit such that the rotary axis 81 of the pre-folding flap 8 is located in the region of a folding groove 117 for the tab 113 of the carton blank. Upon rotation of the pre-folding flap 8 around the rotary axis 81 through approx. 80° to 90°, the tab 113 of the carton blank slides, with its lower side, along the arcuate surface 86 of the pre-folding flap's front member 85. As a result, the tab 113 is folded over by more far than 90° and by up to 180°, depending on the design of the arcuate surface 86 and the distance of the rotary axis 81 from the plane of the carton blank. After drawing the pre-folding flap back into the starting position, the tab 113 of the carton blank remains clear of the carton-blank plane on account of the stretching that has occurred in the region of the carton blank's folding groove 117.

Figure 3:
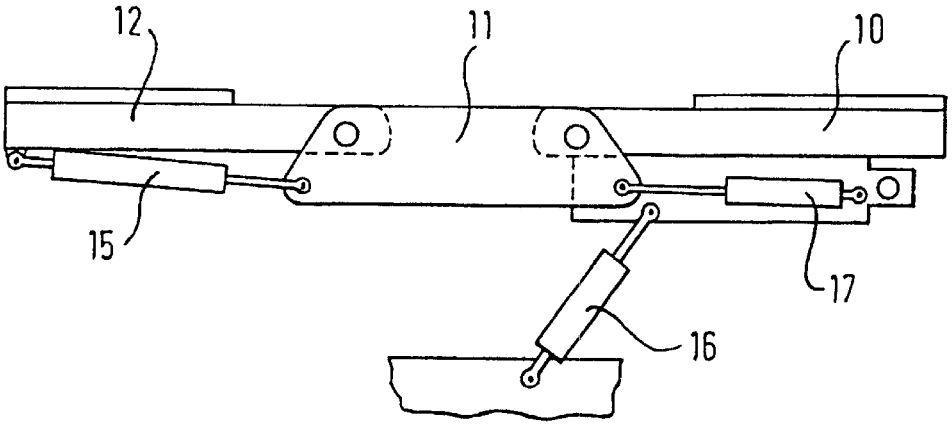
FIG. 3 shows a schematic side view of a three-membered element comprising an erecting and a pressing flap.

FIG. 3 schematically shows a triangular element comprising an erecting flap 10, an intermediate member 11 and a pressing flap 12. The erecting flap 10 is hingedly supported on the support unit. An adjusting cylinder 16 is disposed between the support unit and the erecting flap 10. The erecting flap 10 is hingedly connected to the intermediate member 11. An adjusting cylinder 17 extends between the erecting flap 10 and the intermediate member 11. The intermediate member 11 and pressing flap 12 are in turn hingedly connected together. An adjusting cylinder 15 extends between the intermediate member 11 and the pressing flap 12.

In the starting position, the erecting flap 10, intermediate member 11 and pressing flap 12 form a plane and lie flat, thus causing the side walls of the carton blank to be inserted to end up thereon.

First the adjusting cylinder 16 is actuated for the purpose of erection, causing the entire unit of erecting flap 10, intermediate member 11 and pressing flap 12 to be in a perpendicular position rotated through 90°. The side walls are therefore placed upright by the erecting flap 10. The adjusting cylinders 17 and 15 are then actuated or are actuated immediately after initiation of the movement through 90° for the erecting flap 10, causing the intermediate member and the adjoining pressing flap 12 each to rotate through 90° or 180° with respect to the erecting flap 10. A pressing of the tab and side wall interposed between the erecting flap 10 and pressing flap 12 is therefore achieved.

The manner in which this folding machine operates will hereinafter be described. Carton blanks of different sizes can be folded in the folding machine according to the invention. Depending on the size of the dimensions of the base 111, the longitudinal supports 3 and transverse supports 2 are moved toward or away from one another by means of the rotary handles 22 via the opposed spindles 20, 23; 21, 24. This may, however, also be effected mechanically by means of servomotors. As a result of the opposed arrangement of the spindles, the rotation of the spindles via the handles 22 can now—in relation to the lines of symmetry of the base trestle 1—cause a pair of longitudinal supports 3 or transverse supports 2 to travel symmetrical to the base trestle. The longitudinal supports 3 or transverse supports 2 are adjusted such that the respective fixing means 6 on the support units is located in the corner region of the base 111 of the carton blank. Corresponding settings can be digitally read off an additional display unit.

A robot fitted with grab or suction means is now used to insert a carton blank onto the receiving plane specified by the support units, or the carton blank is manually inserted thereon.

The vertically positionable suction means 51 of the alignment devices 5 are then extended to the base 111 of the carton blank and activated. In this particular case, "activated" means that a subatmospheric pressure is produced at the suction means 51, thus causing the suckers to suck securely at the base 111.

As soon as the base 111 is fixed to the alignment means 5, these means are moved by adjusting cylinders toward the longitudinal supports 3 through a complete stroke. As a result, the narrow side of the carton blank in every case strikes against the abutment surfaces of the corresponding limit stops 4. In the event that the carton blank knocks against the respective limit stops 4 before the complete length of stroke is reached in the longitudinal direction of the alignment means 5, the respective suckers of the alignment means 5 at the lower side of the base 111 slip. This is ensured by corresponding adjustment of the suction force of the suction means 53.

The corresponding movement also occurs in the direction of the transverse supports 2. This means that the carton blank is fixed in the desirable way into a defined position in relation to the support units. The fixing means 6 and the additional suction means 61 are now activated. To do so, the respective suckers of the fixing means 6 or of the suction means 61 are extended upwards and operated at subatmospheric pressure. As a result, the carton base 111 is fixed in a defined position.

The tabs 113 are now glued by the nozzles of the gluing means 7. In other words, a glue or hot-melt adhesive is sprayed on or applied to the tabs from the underneath via the gluing nozzles 7.

A short time later the actuators are used to rotate the pre-folding flaps 8 around the rotary axis 81 through approx. 90°. As a result, the tabs 113, now coated in glue, are bent over almost through 180°. The pre-folding flaps 8 are immediately returned to their starting position again. The bent over tabs 113 nevertheless remain lifted slightly upwards on account of the over-extension that has taken place in the area of the folding groove 117.

Actuation of corresponding adjusting cylinders now causes those erecting flaps 9, 10 located at the corners on the support units and the other interposed erecting flaps 9 to assume a perpendicular position. With a short time delay, the erecting flaps 10 are lifted and place the shorter side walls 112 perpendicular.

All the side walls 112 are therefore now in a perpendicular position; the tabs 113 are located on the inside of the shorter side walls 112. In this position, the lid 114 which is present depending on the design of the carton blank is kept in the perpendicular position by additional suction means.

The intermediate members 11 are now tilted through 90° with respect to the associated erecting flaps 10. The pressing flaps 12 located on the intermediate members 11 are tilted through 90° at the same time or with a short time delay, thus causing the glued tabs 113 to be pressed against the side walls 112.

Depending on the hardening time of the glue or hot-melt adhesive on the tabs 113, the pressing flaps 12, intermediate members 11 and erecting flaps 9, 91 are tilted back into their respective starting positions.

In the meantime, however, a removal means guided on a portal is moved near to the perpendicular lid and takes it by means of suckers.

The suction means of the alignment devices 5 and the fixing devices 6 are then lowered.

The folded folding box can now be transferred from the removal means to a conveyor belt where the folding box prepared in this way is automatically or manually filled with e.g. panels of wood or the like.

The flaps or suction and alignment means are pneumatically adjusted here. But mechanical, electrical or hydraulic adjustment means can also be used without problem.

2nd Embodiment of the Invention

Another embodiment of the folding machine according to the invention is basically designed like the aforementioned folding machine according to FIG. 1.

It does not, however, comprise any gluing means 7. Instead of the three-membered elements with arranging and pressing flaps, only erecting flaps are attached to the support units. A stapling means with which the respective tabs 113 are stapled to the associated side walls 112 in a known manner is also, however, secured to each support unit.

The operating mode of this embodiment will hereinafter be described. The operating mode of the second embodiment of the folding machine according to the invention essentially corresponds to that of the first embodiment. The gluing of the tabs and the process of pressing the tabs 113 and the side walls 112 are, however, omitted. The pressing process is replaced by stapling.

3rd Embodiment of the Invention

The third embodiment of the folding machine according to the invention is used to make folding boxes without additional gluing or stapling. For this purpose, additional inner side walls 116 are present on the carton blank which corresponds to FIG. 6.

The folding machine itself is in turn designed like the folding machine according to FIG. 1, but gluing means 7 are not provided.

The operating mode of this embodiment will hereinafter be described. The operating mode of this third embodiment essentially corresponds to that of the first embodiment. But no gluing process takes place. The additional inner side walls are now folded by the pressing flaps 12 around the tabs 113 that have already been erected.

4th Embodiment of the Invention

A fourth embodiment of the present folding machine according to the invention is provided with just three support units. The limit stops, gluing means and pre-folding flaps are aligned in accordance with the position of the tabs.

The operating mode of this embodiment will hereinafter be described. The operating mode of the fourth embodiment of the folding machine nevertheless continues to correspond to that explained in relation to the first embodiment.

Figure 7:
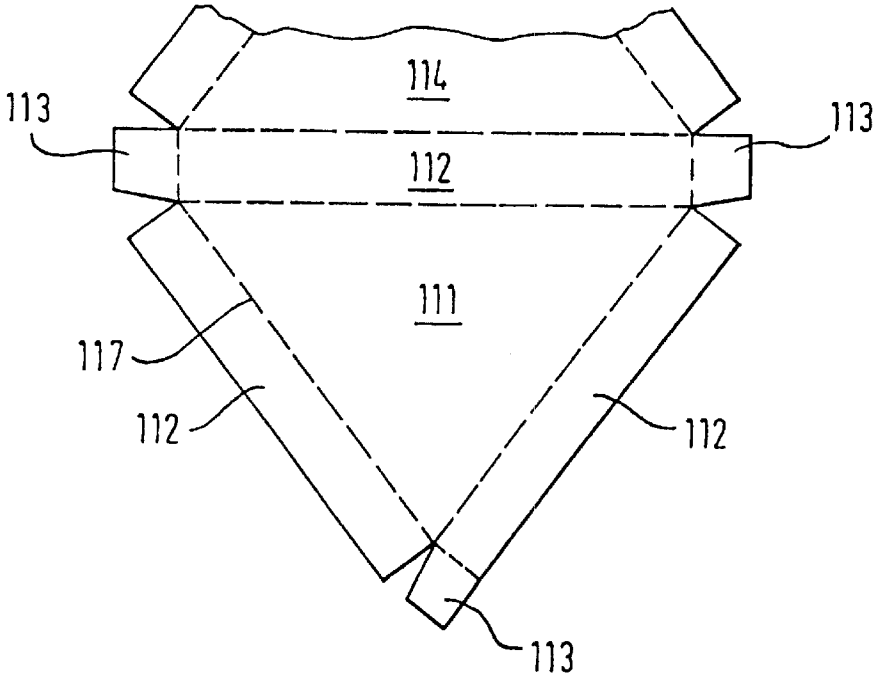
FIG. 7 shows a horizontal projection of a carton blank for a three-sided folding box.

Three-sided folding boxes can therefore be produced by this fourth embodiment which uses a carton blank corresponding to FIG. 7.

Examples of Different Carton Blanks

The carton blank shown in FIG. 4 is used to make a base or lid section of a so-called slip-lid box. In the case of a slip-lid box, a lid is slipped over an upwardly open folding box, in this particular instance the base section.

The associated carton blank comprises a base 111 adjoined by side walls 112 on each side. The transition point from the base 111 to the respective side wall 112 is specified by a folding groove 117 on what will later be the inside of the folding box. Tabs 113 are in turn specified by folding grooves on two opposite sides of the elongated side walls 112. The tabs 113 and the shorter side walls 112 of the carton blank are separated by incisions 118.

Figure 5:
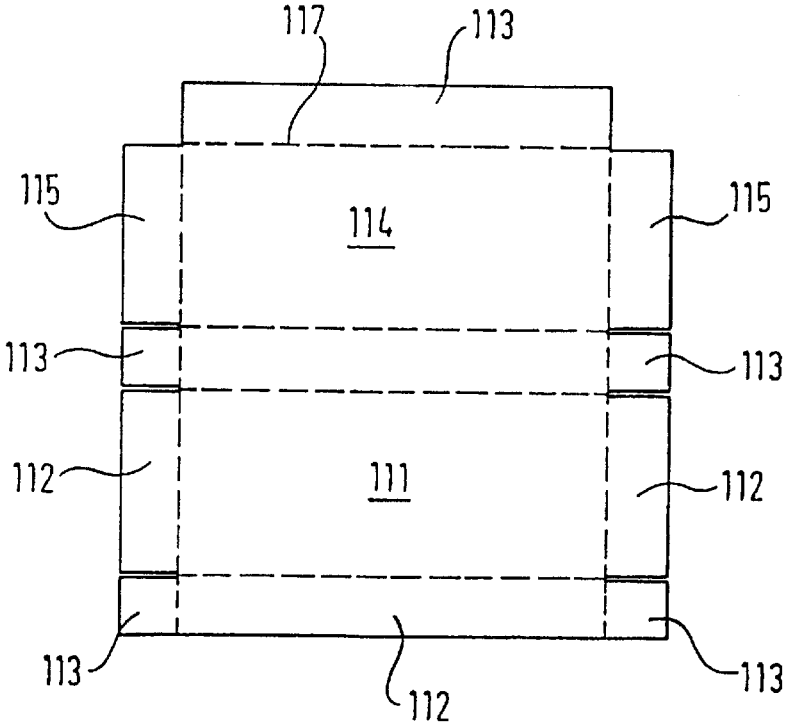
FIG. 5 shows a horizontal projection of a carton blank for a completely enclosed folding box.

FIG. 5 shows another carton blank for making a folding box composed of one section. In addition to the base sections, side walls and tabs evident from FIG. 4, this carton blank comprises a lid 114 that adjoins an elongated side wall and has outer side walls 115.

Figure 6:
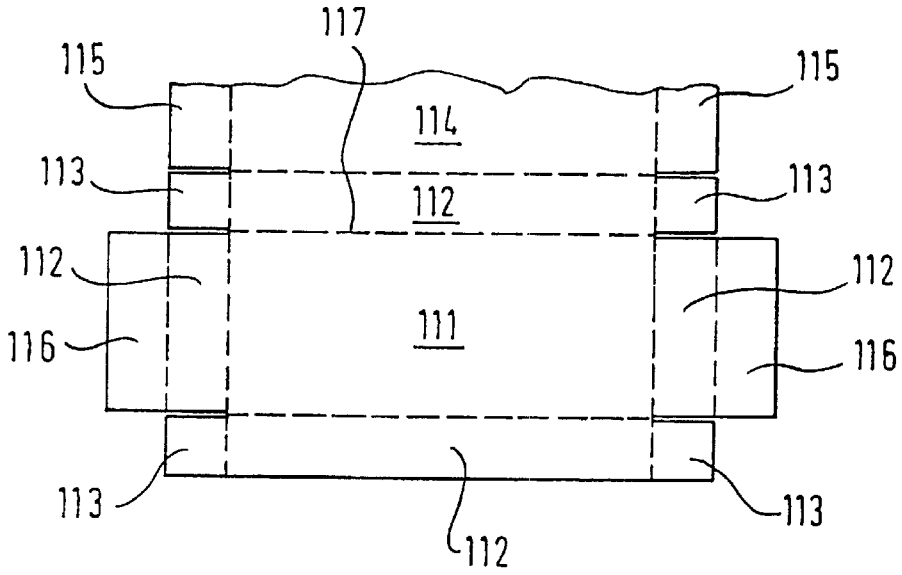
FIG. 6 shows a horizontal projection of a carton blank for a slip lid or slip base with additional inner side walls.

FIG. 6 illustrates a carton blank for making a folding box in which, unlike in the previously described exemplary embodiments of a folding box, it is not necessary to glue the section that forms the lower part of the folding box. The carton blank corresponds to that shown in FIG. 5. Inner side walls 116 are also, however, provided on the shorter side walls 112 of the base 111; these inner side walls 116 are integrally formed with the side walls 112 and are delimited from the side walls 112 by folding grooves 117. After arranging the side walls 112 of the base 111 of this particular carton blank, the inner side walls 116 are inwardly folded so that the tabs 113 end up between the aide walls 112 and the inner side walls 116. As a result, a durable base section of a box is formed without gluing, stapling or using an adhesive.

A final exemplary embodiment of a carton blank is evident from FIG. 7. This carton blank basically corresponds to one according to Fig. 5, but comprises just three instead of four base sides. This means that a triangular folding box can be produced. This carton blank comprises two opposite tabs 113 on the side wall, of which the lid 114 is a continuation. A further tab 113 is formed on a side wall 112 at the remaining corner of the base 111. The folds are in turn formed as a result of folding grooves 117.

What is claimed is:

1. A folding machine for making a glued folding box made from a pre-grooved carton blank having a base with a plurality of sides and side walls, one side wall being respectively formed on each base side and each side wall being defined by one folding groove, said carton blank having a plurality of tabs serving to glue two adjacent side walls when a carton blank is folded, wherein said folding machine comprises:

a receiving plane on which said carton blank is placed, at least one alignment means for aligning said carton blank into a fixed predetermined position on said receiving plane, a plurality of pre-folding flaps, one pre-folding flap being associated with one tab of said carton blank, for lifting the associated tab out of said receiving plane, said pre-folding flaps being movable on said receiving plane, at least one fixing means for securing said carton blank in the predetermined position on said receiving plane, a plurality of erecting flaps movable on said receiving plane, at least one of said erecting flaps being provided for each side wall of said carton blank to erect the side wall out of said receiving plane, a plurality of connecting means for connecting the tabs to the associated side walls, at least one connecting means being assigned to one tab of said carton blank, and each connecting means comprising:

gluing means movable on said receiving plane and associated with a tab for gluing the tab to an adjacent side wall of said carton blank, and a pressing flap for compressing the tab glued by said gluing means and the associated erected side wall of said carton blank, said pressing flap being movable on said receiving plane.

2. A folding machine according to claim 1, wherein said carton blank has a lower side and an upper side, each gluing means comprising at least one nozzle directed at a lower side of the respective tab of said carton blank, said nozzle being used to apply a suitable adhesive to the lower side of the respective tab.

3. A folding machine according to claim 1, wherein a hot-melt adhesive is used as an adhesive in each gluing means.

4. A folding machine according to claim 1, further comprising:

support units movable on said receiving plane, wherein one of said pre-folding flaps for lifting the tabs and at least one of said erecting flaps at each side wall of said carton blank are disposed on said support units.

5. A folding machine according to claim 4, wherein each pre-folding flap comprises a hook-shaped element rotatable around a rotary axis.

6. A folding machine according to claim 4, wherein said pre-folding flap is rotatable by an angle greater than 45° by means of an adjusting cylinder.

7. A folding machine according to claim 5, wherein said hook-shaped element comprises an arcuate surface facing toward the respective tab of said carton blank.

8. A folding machine according to claim 5, wherein a coupling point for the adjusting cylinder is spaced apart from the rotary axis of said hook-shaped element.

9. A folding machine according to claim 5, wherein the respective tab of said carton blank is located in the outer region of said hook-shaped element when said carton blank is in an unfolded state, and the rotary axis of said hook-shaped element is disposed in the region of the folding groove in said carton blank.

10. A folding machine according to claim 1, further comprising:

at least two movable limit stops and two alignment means, one alignment means being movable in the direction of one limit stop.

11. A folding machine according to claim 10, wherein said limit stops are movably aligned in two directions perpendicular to one another.

12. A folding machine according to claim 11, further comprising:

support units, said support units being movable on said receiving plane, wherein one of said pre-folding flaps for lifting a tab of said carton blank and at least one of said erecting flaps at each side wall of said carton blank are disposed on each support unit, and wherein said limit stops are movably disposed on said support units.

13. A folding machine according to claim 10, wherein each alignment means can move in the direction of a limit stop by means of an adjusting cylinder.

14. A folding machine according to claim 1, wherein said fixing means secures a lower side of said carton blank by suction means.

15. A folding machine according to claim 10, wherein each alignment means is moveable in the direction of said limit stops through a complete stroke of an associated adjusting cylinder, the suction force of said suction means of said fixing means being calculated so as to be sufficient to secure said carton blank, though upon impact with one of said limit stops, said suction means is slidable relative to said carton blank.

16. A folding machine according to claim 1, further comprising:

support units, wherein each support unit comprises said fixing means in a corner region of the base of said carton blank.

17. A folding machine according to claim 1, wherein each erecting flap is rotatable through 90° out of said receiving plane for said carton blank by means of an adjusting cylinder.

18. A folding machine according to claim 1, wherein four supports are disposed on a rectangular base trestle, two of said supports being spaced apart from one another in parallel and each pair of supports being disposed perpendicular to one another.

19. A folding machine according to claim 18, wherein said respectively parallel supports are moveable toward or away from one another respectively by spindles which work in opposite directions.

20. A folding machine according to claim 18, further comprising:

support units movable on said receiving plane, wherein one of said pre-folding flaps for lifting the tabs and at least one of said erecting flaps at each side wall of said carton blank are disposed on said support units, and wherein said support units each are movably disposed in the region of intersecting supports and along said supports.

21. A folding machine according to claim 18, wherein said erecting flaps are disposed on said supports.

22. A folding machine according to claim 1, wherein each pressing flap is rotatably disposed on said erecting flaps via an intermediate member.

23. A folding machine according to claim 22, wherein each erecting flap is rotatable through 90° by means of a first adjusting cylinder, said associated intermediate member is rotatable through 90° with respect to said erecting flap by means of a second adjusting cylinder, and said pressing flap is rotatable through 90° with respect to said intermediate member by means of a third adjusting cylinder.

24. A folding machine according to claim 1, wherein the pre-folding flap is operable to lift the associated tab out of the receiving plane such that the tab remains clear of a carton-blank plane due to stretching that has occurred in a region of the carton blank's folding groove after drawing the pre-folding flap back into a starting position.

25. A process of automatically folding a folding box made from a pre-grooved carton blank having a base with a plurality of sides and side walls, one side wall being formed on one base side and being defined by one folding groove, said carton blank having a plurality of tabs serving to connect two adjacent side walls when a carton blank is folded, wherein said process comprises:

placing said carton blank onto a receiving plane, subsequently aligning said carton blank into a predetermined fixed position, holding said thus aligned carton blank at a lower side of the base, folding over the tabs of said carton blank to such an extent that without aids they continue to project out of a plane defined by said carton blank, and mechanically erecting the side walls of said carton blank and holding them until they have been connected to the associated tabs.

26. A process according to claim 25, wherein said tabs have a lower side and an upper side, wherein an adhesive agent is applied to the lower side of each tab and the tabs coated with the adhesive agent are connected to the side walls by mechanical compression after erection of the side walls of said carton blank.

* * * * *